United States Patent [19]

Zalesak

[11] Patent Number: 5,031,897

[45] Date of Patent: Jul. 16, 1991

[54] ROLLER SLIDE

[75] Inventor: Jon Zalesak, Whitelaw, Wis.

[73] Assignee: American Toy & Furniture Co., Inc., Hortonville, Wis.

[21] Appl. No.: 485,990

[22] Filed: Feb. 27, 1990

[51] Int. Cl.[5] ..... A61G 21/18

[52] U.S. Cl. ..... 272/56.5 R

[58] Field of Search ..... 272/56.5 R, 1 B, 1 E, 272/56.5 SS; 104/70, 69, 249

[56] References Cited

U.S. PATENT DOCUMENTS

| | | | |
|---|---|---|---|
| 1,707,854 | 4/1929 | Hanlon | 272/56.5 R |
| 2,170,935 | 8/1939 | Whiteley | 272/56.5 R |
| 3,385,599 | 5/1968 | Davis | 272/56.5 R |
| 4,319,201 | 7/1983 | Bailey | 272/56.5 R |

FOREIGN PATENT DOCUMENTS

| | | | |
|---|---|---|---|
| 180744 | 7/1936 | Switzerland | 272/56.5 R |

*Primary Examiner*—Richard E. Chilcot, Jr.

*Attorney, Agent, or Firm*—Reinhart, Boerner, Van Deuren, Norris & Rieselbach

[57] ABSTRACT

A children's playground slide having a slide portion including side support rails, cylindrical bearing housings coupled to the each of the support rails. The slide also includes a plurality of roller cylinders between the support rails thereby defining a sliding surface.

15 Claims, 2 Drawing Sheets

ROLLER SLIDE

This invention is concerned generally with a children's playground slide. More particularly, the invention is concerned with a playground slide having a sliding surface constructed from a plurality of rotatably mounted roller cylinders.

Playground slides have typically been constructed of metal, including a slick metal sliding surface. In order to achieve good sliding speed and the desired recreational excitement, the top of the slide has typically been positioned at a relatively steep angle. Such an angle often requires the starting location being quite high and therefore creating a safety hazard for children, as well as causing fear and apprehension in a child using the slide. In addition, conventional slides are also occasionally abused by using the sliding surface itself and/or the side support rails to climb to the top of the slide. Consequently, under normal use conventional slides are potentially dangerous and when abused as described above, such typical slides can be highly dangerous. Whatever the nature of use, if a child does fall off a conventional slide, there is a substantial probability of serious injury to the child. Moreover, many children, particularly younger ones, do not even use conventional playground slides because they require starting the slide at an unreasonably high level from the ground. In such conditions, fear and apprehension prevent such younger children from even using a playground slide.

It is therefore an object of the invention to provide an improved playground slide and method of manufacturing such a slide.

It is another object of the invention to provide a novel playground slide having a sliding surface mounted at low heights and a modest angle of descent, while still providing good sliding velocity.

It is a further object of the invention to provide an improved children's playground slide which uses rotatably mounted cylindrical roller tubes having protected bearing surfaces for avoiding entrapment of foreign material in the bearings.

It is an additional object of the invention to provide a novel method of manufacturing a child's playground slide surface which readily enables construction of widely diverse slide surface geometries.

Further objects and advantages of the present invention, together with the organization and manner of operation thereof, will become apparent from the following detailed description of the invention when taken in conjunction with the accompanying drawings wherein like reference numerals designate like elements in the several views.

DETAILED DESCRIPTION OF A PREFERRED EMBODIMENT

Figure 1A:
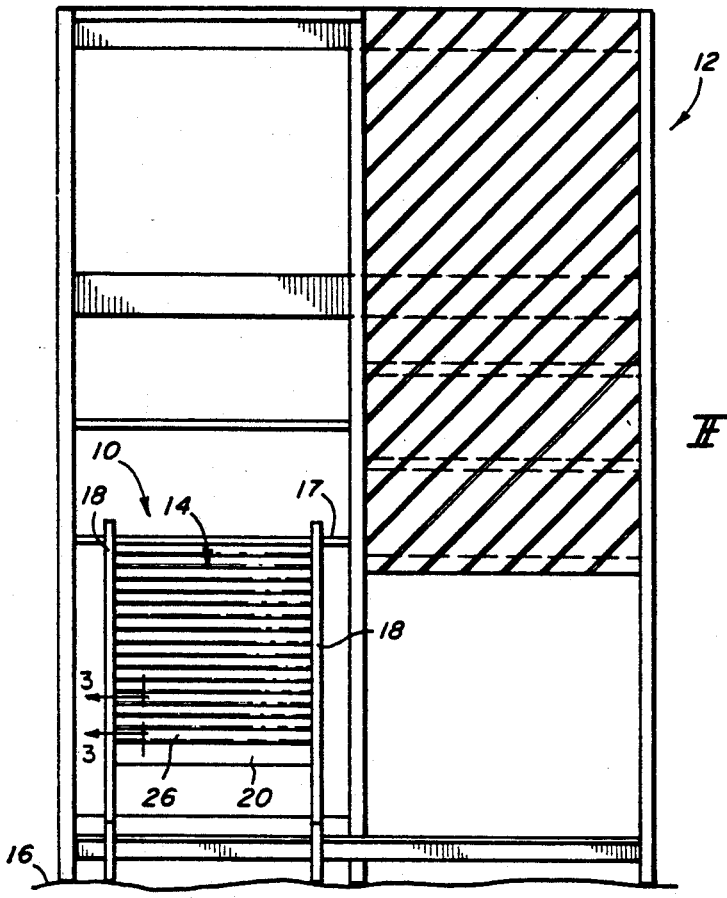
FIG. 1A illustrates a front elevation and FIG. 1B a side elevation of a children's playground slide constructed in accordance with the invention.

Referring to the drawings and in particular to FIG. 1, a children's playground slide constructed in accordance with the invention is illustrated generally at 10. A support means, such as an open structure jungle gym 12, is attached to the elevated end of a slide portion 14 with the lower end resting on ground 16. The jungle gym 12 (or other such play structure) provides a climbing structure which allows a child to climb to a platform 17 for the child to start the slide from the elevated end of the slide portion 14.

Figure 2A:
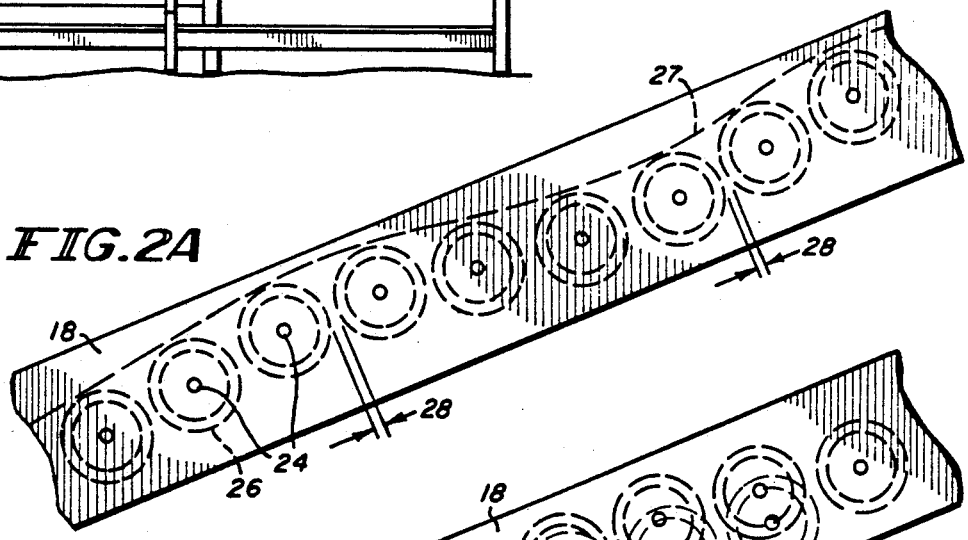
FIG. 2A illustrates a partial view of a side elevation of the slide portion of a children's playground slide with a first form of slide surface shown edge-on as a dashed line with roller cylinders shown in phantom and FIG. 2B shows another partial view of a side elevation of the slide portion of a children's playground slide with the closer ends of the roller cylinders shown in dashed phantom lines and the farther roller cylinders shown in dotted phantom line.
Figures 1B, 3:
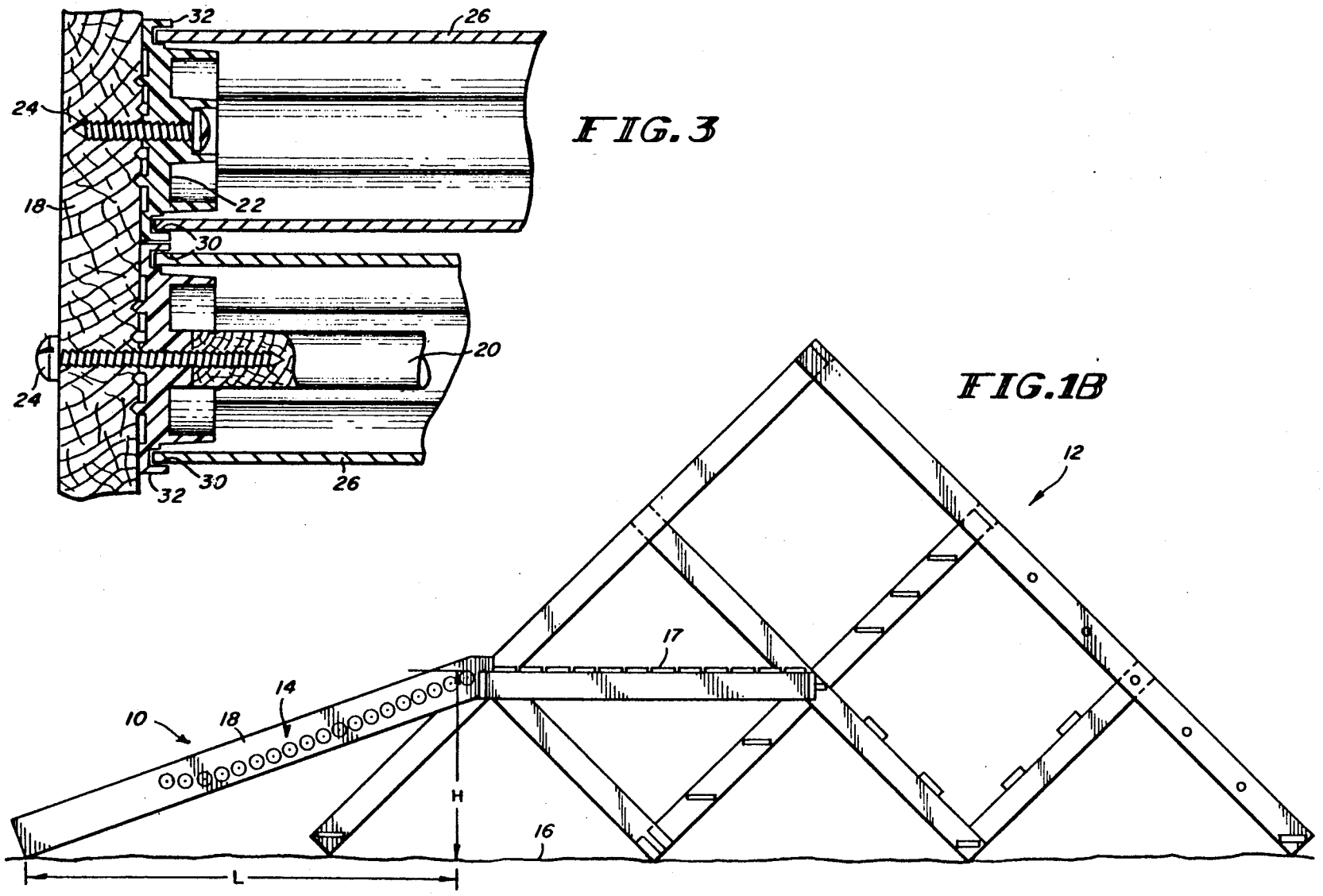
FIG. 3 shows a partial cross section taken along 3—3 of FIG. 1A of the slide portion of a children's playground slide.

Slide portion 14 includes side support rails 18 joined together by cross struts 20. As shown in FIG. 3, cylindrical bearings 22 are coupled by fasteners 24 to the side support rails 18. Roller cylinders 26 are rotatably coupled to the cylindrical bearings 22, and the plurality of the cylinders 26 cooperate to form a sliding surface 27 for the children (see the phantom dash line in FIG. 2A illustrating one path of the sliding surface). The longitudinal spacing 28 (see FIG. 2A) of the roller cylinders 26 is also chosen to prevent a child from entangling clothing or from passing hands or fingers between the roller cylinders 26.

The cylindrical bearings 22 are preferably constructed in the manner shown in FIG. 3. Each of the cylindrical bearings 22 is an injection molded plastic (such as the various materials described hereinafter used as materials for the roller cylinders 26). The roller cylinders 26 are seated within recesses 30 of the bearings 22 for contained rotational contact with the bearing surfaces. The recesses 30 are formed by protective sheaths 32 of the cylindrical bearings 22 which act to prevent entry into the active area of the bearings 22 of foreign materials, such as dirt, grass, and children's clothing, such as clothing tie strings and coats, hats and gloves. The protective sheath 22 therefore acts to maintain the high level of sliding performance provided by the plurality of the roller cylinders 26, while also performing important safety functions.

The roller cylinders 26 themselves are a plastic material selected from a group of self-lubricating materials and/or low friction materials, such as, for example, conventional high density polyethylene (HDPE), acetyl resin/polytetrafluoroethylene resin mixtures, polytherimide (such as a product sold as Ultem—a General Electric trademark) and select polyesters (such as a product sold as Valox, a General Electric trademark). Such materials have excellent low friction and/or self-lubricating character when they are used for sliding mechanical contact applications. These self-lubricating and/or low friction properties for these materials, coupled with the use of the plurality of roller cylinders 26 and the cylindrical bearings 22, enables the gradient ratio of the height (H in FIG. 1) of the slide 10 to the length (L in FIG. 1) to be substantially less than in normal playground slides. The child can still achieve good sliding speed even though the gradient ratio is quite small, typically one third to one half. These enhanced performance sliding characteristics allow the slide 10 to be constructed with a much lower height from the ground for the elevated starting end. This features makes the slide 10 inherently safer and less threatening to children playing on the slide 10.

Figure 2B:
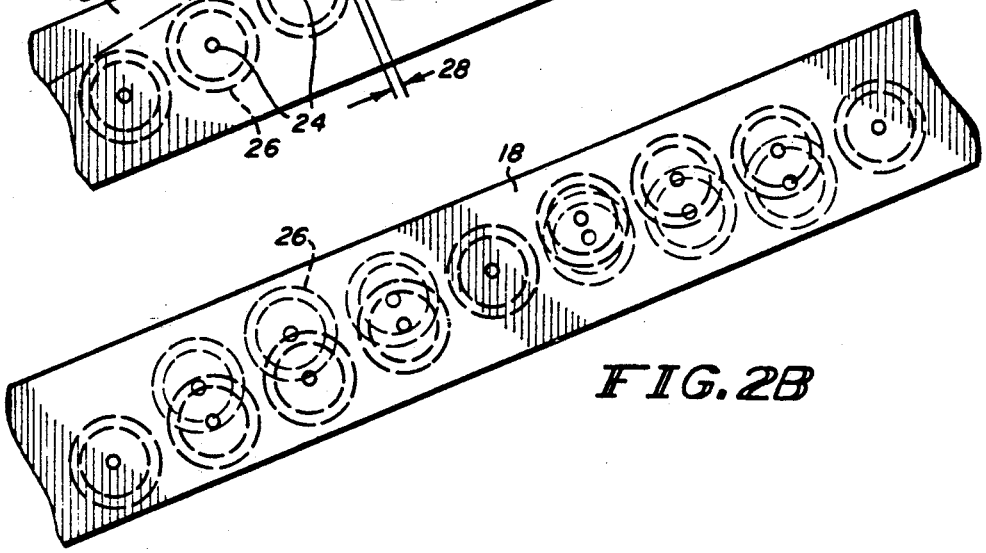

In addition to having excellent sliding performance and safety characteristics, the sliding surface 27 of the slide 10 can readily be designed to achieve a variety of geometries. For example, as shown in FIG. 1B and in FIG. 2, the roller cylinders 26 and the coupled cylindrical bearings 22 can be positioned at various locations and angles relative to the sides of support rails 18. In FIG. 2A, the resulting sliding surface has an undulating, or sinusoidal, geometry and in FIG. 2B the sliding surface has undulations both longitudinally and also transversely. This latter geometry requires the bearings 22 to be mounted at a slight angle relative to perpendicular to the side support rails 18. This versatility in constructing sliding surfaces clearly allows construction of unusual geometries which can include small hills, turns in the sliding surface and other complex geometries which were heretofore extremely difficult to provide using conventional slide construction techniques.

While preferred embodiments have been illustrated and described, it should be understood that changes and modifications can be made therein without departing from the invention in its broader aspect. Various features of the invention are defined in the following claims.

What is claimed is:

1. A children's playground slide, comprising:

a slide portion including side support rails, cylindrical bearing housings coupled to and extending inwardly from each side of said side support rails and a plurality of roller cylinders with each of said roller cylinders disposed as a single continuous unit between said side support rails, and said cylinders matingly disposed circumferentially about an associated inwardly extending cylindrical bearing, each pair of said cylindrical bearings supporting only a fraction of the length of each associated said roller cylinder and said plurality of cylinders defining a sliding surface; and support means coupled to said slide portion for holding one end of said slide portion in an elevated position and for providing a climbing structure leading to a starting position for the child to slide down from the elevated end of said slide portion.

2. The children's playground slide as defined in claim 1 wherein said cylindrical bearings further include a protective sheath member for preventing entry of foreign materials into said cylindrical bearings.

3. The children's playground slide as defined in claim 1 wherein said support means comprises a climbing gym structure.

4. A slide portion of a children's playground slide, comprising:

side support rails fixedly coupled together;

cylindrical bearings coupled to and extending inwardly from said side support rails with said cylindrical bearings on each side extending only a fraction of the total width between said side support rails; and a plurality of roller cylinders rotatably coupled to said cylindrical bearings, said roller cylinders being a single piece with more than half of said roller cylinders being supported between said side support rails only by said cylindrical bearings, said plurality of roller cylinders and associated cylindrical bearings selectively located between said side support rails for forming a slide surface having a predetermined geometry.

5. The children's playground slide portion as defined in claim 4 wherein said cylinders and bearings are positioned to form selectively at least one of a longitudinally and transversely undulating surface geometry.

6. The children's playground slide portion as defined in claim 4 wherein said cylinder bearings further include a protective sheath member for preventing entry of foreign materials into said cylindrical bearings.

7. A children's playground slide, comprising:

a slide portion including side support rails joined together and a plurality of roller cylinders extending as a single piece between said side support rails and rotatably coupled to said side support rails using cylindrical bearings extending inwardly from said side support rails a fraction of the distance therebetween said rails to support said roller cylinders, said plurality of roller cylinders forming a sliding surface; and support means coupled to said slide portion for holding one end of said slide portion in an elevated position, the gradient ratio of the height of said slide portion at the elevated end to the length of said slide portion being between about one half and one third and said support means also for providing a climbing structure leading to a starting platform for the child to slide down from the elevated end of said slide portion.

8. The children's playground slide as defined in claim 7 wherein said cylindrical bearings further include protective sheath members for preventing entry of foreign materials into said cylindrical bearings.

9. The children's playground slide as defined in claim 7 wherein said support means comprises a climbing gym structure.

10. A children's playground slide, comprising:

a slide portion including side support rails joined together at selected points by fixed cross struts and a plurality of roller cylinders, each of said cylinders extending as a single unit between said side support rails and each of said cylinders rotatably coupled to said side support rails using a pair of cylindrical bearings extending inwardly only a fraction of the distance between said side support rails, said roller cylinders forming a sliding surface, and said cylinders comprising a plastic material having self-lubricating and/or low friction characteristics enabling enhanced sliding speed over said roller cylinders; and support means coupled to said slide portion for holding one end of said slide portion in an elevated position and for providing a climbing structure leading to a starting platform for the child to slide down from the elevated end of said slide portion.

11. The children's playground slide as defined in claim 10 wherein said plastic material is selected from the group consisting essentially of high density polyethylene, polytherimide, polyester and acetyl resin/-polytetrafluoroethylene resin mixtures.

12. The children's playground slide as defined in claim 10 wherein said cylindrical bearings further include protective sheath members for preventing entry of foreign materials into said cylindrical bearings.

13. A children's playground slide, comprising:

a slide portion including side support rails joined together by fixed cross struts at pairs of selected points along the slide length;

cylindrical bearings coupled to said side support rails at more location than said cross struts and extending only a fraction of the distance between said side support rails and a plurality of roller cylinders, each of said cylinders rotatably coupled as a single unit to said cylindrical bearings and forming a sliding surface for use by the children, and said cylindrical bearings including protective sheath members for preventing entry of foreign materials into said cylindrical bearings; and a children's play platform structure attached to the elevated end of said slide portion and said platform providing a climbing structure and a starting location for the children to slide down from the elevated end of said slide portion.

14. The children's playground slide as defined in claim 13 wherein said play platform comprises at least one of a jungle gym and a playhouse.

15. The children's playground slide as defined in claim 13 wherein said cylindrical bearings comprise a molded material.

* * * * *